US008091723B2

(12) United States Patent
Li et al.

(10) Patent No.: US 8,091,723 B2
(45) Date of Patent: Jan. 10, 2012

(54) REMOVABLE LID FOR USE WITH A TONER CONTAINER

(75) Inventors: Kuan Tung Li, Taichung County (TW); Yueh Chun Lee, Taichung County (TW)

(73) Assignee: General Plastics Industrial Co., Ltd., Taichung County (TW)

( * ) Notice: Subject to any disclaimer, the term of this patent is extended or adjusted under 35 U.S.C. 154(b) by 877 days.

(21) Appl. No.: 11/483,447

(22) Filed: Jul. 10, 2006

(65) Prior Publication Data

US 2008/0008493 A1 Jan. 10, 2008

(51) Int. Cl.

| | |
|---|---|
| ***B65D 53/00*** | (2006.01) |
| ***E05C 19/06*** | (2006.01) |
| ***E05B 17/20*** | (2006.01) |
| ***E05B 39/02*** | (2006.01) |
| ***E05B 63/18*** | (2006.01) |
| ***B67D 7/84*** | (2010.01) |
| ***G03G 15/08*** | (2006.01) |

(52) U.S. Cl. ..... 220/233; 292/81; 292/88; 222/167; 399/262; 399/258; 399/260

(58) Field of Classification Search ..... 220/223, 220/167; 292/81, 88; 222/167
See application file for complete search history.

(56) References Cited

U.S. PATENT DOCUMENTS

| | | | | |
|---|---|---|---|---|
| 1,553,613 | A | 9/1925 | Holthoff | |
| 2,644,610 | A * | 7/1953 | Work | 220/210 |
| 2,746,632 | A | 5/1956 | Bramming | |
| 2,965,266 | A | 12/1960 | Rutkus, Jr. et al. | |
| 3,382,887 | A | 5/1968 | Erickson | |
| 3,853,246 | A | 12/1974 | Dubois | |
| 3,915,340 | A | 10/1975 | Koeleman | |
| 3,979,026 | A | 9/1976 | Lee | |
| 4,212,264 | A | 7/1980 | Knechtel et al. | |
| 4,611,730 | A | 9/1986 | Ikesue et al. | |
| 4,641,945 | A | 2/1987 | Ikesue et al. | |
| 4,744,493 | A | 5/1988 | Ikesue et al. | |
| 4,778,320 | A * | 10/1988 | Nakama | 411/509 |
| 4,949,123 | A | 8/1990 | Takashima | |
| 5,049,941 | A | 9/1991 | Manno et al. | |
| 5,078,303 | A | 1/1992 | Kikuchi et al. | |
| 5,218,407 | A | 6/1993 | Matsushita et al. | |

(Continued)

FOREIGN PATENT DOCUMENTS

| | | |
|---|---|---|
| JP | 60243681 | 12/1985 |

*Primary Examiner* — Anthony Stashick
*Assistant Examiner* — Andrew T Kirsch
(74) *Attorney, Agent, or Firm* — Morris Manning & Martin LLP; Tim Tingkang Xia, Esq.

(57) ABSTRACT

A lid to selectively plug or unplug a discharge mouth of a toner container mountable to an image forming apparatus for replenishing a toner. In one embodiment, a lid has a body member having a bottom portion with an opening, a lug member having a body portion having a first end portion, and a base member having an opening. The body portion of the lug member is sized to be received into the opening of the bottom portion of the body member and into the opening of the base member to engage the body member with the base member. The body portion of the lug member is received into the opening of the bottom portion of the body member and into the opening of the base member, the first end portion of the body portion of the lug member snaggingly fits through the opening of the base member.

11 Claims, 6 Drawing Sheets

(A)

(B)

U.S. PATENT DOCUMENTS 5,257,077 A 10/1993 Peters, Jr. et al.
5,293,913 A 3/1994 Preszler
5,296,900 A 3/1994 Saijo et al.
5,307,129 A 4/1994 Miura et al.
5,455,662 A 10/1995 Ichikawa et al.
5,489,976 A 2/1996 Ichikawa
5,500,719 A 3/1996 Ichikawa et al.
5,627,631 A 5/1997 Ichikawa et al.
5,649,859 A * 7/1997 Shiga ..... 454/275
5,655,195 A 8/1997 Ichikawa et al.
5,822,663 A 10/1998 Ichikawa et al.
5,828,935 A 10/1998 Tatsumi et al.
5,918,090 A 6/1999 Ichikawa et al.
6,075,963 A * 6/2000 Ichikawa et al. ..... 399/262
6,137,972 A * 10/2000 Playfair et al. ..... 399/106
6,289,195 B1 9/2001 Ichikawa et al.
6,418,293 B2 7/2002 Ichikawa et al.
6,885,840 B2 4/2005 Huang et al.
2004/0151560 A1 * 8/2004 Kirchen ..... 411/508

* cited by examiner (B)

(A)

(C)

(B)

(A)

REMOVABLE LID FOR USE WITH A TONER CONTAINER

FIELD OF THE PRESENT INVENTION

The present invention relates to a toner supply container for replenishing toner into an image forming apparatus such as an electrophotographic copying machine or a printer, and more particularly, to a toner supply container for replenishing toner into an image forming apparatus, that has a lid selectively plug or unplug a discharge mouth of a developer container mountable to an image forming apparatus for replenishing a developer.

BACKGROUND OF THE PRESENT INVENTION

Heretofore, toner in the form of fine particles is used as a developer in the image forming apparatus such as an electrophotographic copying machine or a printer. When the developer in a main assembly of the image forming apparatus is used, the toner is supplied into the image forming apparatus using a toner supply container. When the toner is used up, a new toner supply container or toner bottle with a supply of the toner is provided to replace the used-up toner supply container, which then is discarded. FIG. 5 shows a specific configuration of a related art toner bottle 420 while FIG. 6 shows a mouth portion 423 forming the outlet of the bottle 420. As shown, the bottle 420 is substantially cylindrical and provided with the mouth portion 423 at substantially the center of one end thereof. The mouth portion 423 has a smaller diameter than the cylinder constituting the bottle 420 and has a circular section. In the specific configuration, the mouth portion 423 is formed at the end of a collar 424 extending out from the cylinder 420 and is plugged by a lid 425. A lug member 426 with a body portion and a mushroom-like cap portion protrudes from the center of the lid 425 and is used as a handler for plugging or unplugging utility. A spiral guide groove 427 is formed in the inner periphery of the cylinder 420. When the bottle 420 is rotated about the longitudinal axis thereof, the spiral groove 427 guides the toner contained in the bottle 420 toward the mouth portion 423.

One disadvantage associated with the bottle 420, in particular, the lid 425, is that a user may accidentally nip the lug member 426 of the lid 425, which, when the user uses enough force, may break the bottom portion of the lid 425 so as to cause toner falling from the bottle 420.

Suggestions or modifications were made to overcome this disadvantage. For example, as shown in FIG. 7, a lid 425 was provided with pin-like obstructions 426*b* around the lug member 426. While the obstructions 426*b* may prevent the easy access of a user's fingers to the lug member 426, the user may still reach the lug member 426 and accidents may still occur.

Therefore, a heretofore unaddressed need exists in the art to address the aforementioned deficiencies and inadequacies.

SUMMARY OF THE PRESENT INVENTION

In one aspect, the present invention relates to a lid to selectively plug or unplug a discharge mouth of a toner or developer container mountable to an image forming apparatus for replenishing a toner or developer container. In one embodiment, the lid comprises: (i) a body member having a bottom portion and a sidewall portion, (ii) a lug member having a first end portion and a second end portion defining a body portion, and (iii) a base member having a base portion having a first surface and a second, opposite surface, and a body portion protruding away from the second, opposite surface and defining an opening with the base portion. The bottom portion has an inner surface and an outer surface and defines an opening. The sidewall portion has an inner surface and an outer surface. The body portion of the lug member is sized to be received into the opening of the bottom portion of the body member and into the opening of the base member to engage the body member with the base member. The base portion of the base member is formed with a resilient material such that when the body portion of the lug member is received into the opening of the bottom portion of the body member and into the opening of the base member, which is in communication with the opening of the bottom portion of the body member, the first end portion of the body portion of the lug member snaggingly fits through the opening of the base member.

In one embodiment, the body member of the lid further comprises an engaging portion formed around the opening of the body member and extending outwardly from the sidewall portion of the body member and sized to engage with the discharge mouth of a toner or developer container when the lid plugs the discharge mouth. In one embodiment, the sidewall portion of the body member comprises a cylindrical portion and a conical portion. The conical portion adjoins the cylindrical portion and the bottom portion. The body member further comprises a plurality of annular ribs formed on the outer surface of the cylindrical portion.

In one embodiment, the body member of the lid further defines a recess on the inner surface of the bottom portion of the body member. The recess is sized to receive the engagement portion formed on the body portion of the lug member. The body portion of the lug member is received into the opening of the bottom portion of the body member and into the opening of the base member.

In one embodiment, the lug member further comprises an engagement portion formed on the body portion of the lug member and extending outwardly from the body portion of the lug member. The first end portion of the lug member comprises a conical tip portion, a conical engagement portion, and a step portion joining the conical tip portion and the conical engagement portion.

In one embodiment, the base member further comprises a conical tip portion corresponding to the first end portion of the lug member such that when the first end portion of the body portion of the lug member snaggingly fits through the opening of the base member, the conical tip portion of the base member is received at the step portion of the first end portion of the lug member. The base member may further comprise a plurality of ridges formed equiangularly apart from each other on the second surface of the base portion and joining the body portion of the base member.

In another aspect, the present invention relates to a lid to selectively plug or unplug a discharge mouth of a toner or developer container mountable to an image forming apparatus for replenishing a toner or developer container. In one embodiment, the lid comprises: (i) a body member having a bottom portion and a sidewall portion, (ii) a lug member having a first end portion and a second end portion defining a body portion, and (iii) a base member having a base portion having a first surface and a second, opposite surface, and a body portion protruding away from the second, opposite surface and defining an opening with the base portion. The bottom portion has an inner surface and an outer surface and defines an opening, and the sidewall portion has an inner surface and an outer surface. The body portion of the lug member is sized to be received into the opening of the bottom portion of the body member and into the opening of the base member to engage the body member with the base member.

In one embodiment, the base portion of the base member is formed such that when the body portion of the lug member is received into the opening of the bottom portion of the body member and into the opening of the base member, the first end portion of the body portion of the lug member snaggingly fits through the opening of the base member. The body member of the lid further comprises an engaging portion formed around the opening of the body member and extending outwardly from the sidewall portion of the body member and sized to be able to engage with the discharge mouth of a toner or developer container when the lid plugs the discharge mouth. The body member of the lid further defines a recess on the inner surface of the bottom portion of the body member, and wherein the recess is sized to receive the engagement portion formed on the body portion of the lug member therein when the body portion of the lug member is received into the opening of the bottom portion of the body member and into the opening of the base member.

In one embodiment, the lug member further comprises an engagement portion formed on the body portion of the lug member and extending outwardly from the body portion of the lug member. The first end portion of the lug member comprises a conical tip portion, a conical engagement portion, and a step portion joining the conical tip portion and the conical engagement portion.

In one embodiment, the base member further comprises a conical tip portion corresponding to the first end portion of the lug member such that when the first end portion of the body portion of the lug member snaggingly fits through the opening of the base member, the conical tip portion of the base member is received at the step portion of the first end portion of the lug member.

In yet another aspect, the present invention relates to a lid to selectively plug or unplug a discharge mouth of a toner or developer container mountable to an image forming apparatus for replenishing a toner or developer container. In one embodiment, the lid comprises: (i) a body member having a bottom portion and a sidewall portion, (ii) a lug member having a first end portion and a second end portion defining a body portion; and (iii) a base member having a base portion having a first surface and a second, opposite surface, and a body portion protruding away from the second, opposite surface and defining an opening with the base portion. The bottom portion has an inner surface and an outer surface and defines an opening, and the sidewall portion has an inner surface and an outer surface. The lug member snaggingly fits through the opening of the body member and the opening of the base member.

In one embodiment, the body member of the lid further comprises an engaging portion formed around the opening of the body member and extending outwardly from the sidewall portion of the body member and sized to be able to engage with the discharge mouth of a toner or developer container when the lid plugs the discharge mouth.

In one embodiment, the body portion of the lug member is sized to be received into the opening of the bottom portion of the body member and into the opening of the base member to engage the body member with the base member.

In one embodiment, the base portion of the base member is formed with a resilient material such that when the body portion of the lug member is received into the opening of the bottom portion of the body member and into the opening of the base member, which is in communication with the opening of the bottom portion of the body member, the first end portion of the body portion of the lug member snaggingly fits through the opening of the base member.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers, and wherein:

FIG. 2A is a perspective view of the assembled removable lid for use with a toner or developer container, and FIG. 2B is a perspective sectional view of the assembled removable lid for use with a toner or developer container.

DETAILED DESCRIPTION OF THE PRESENT INVENTION

Figure 1:
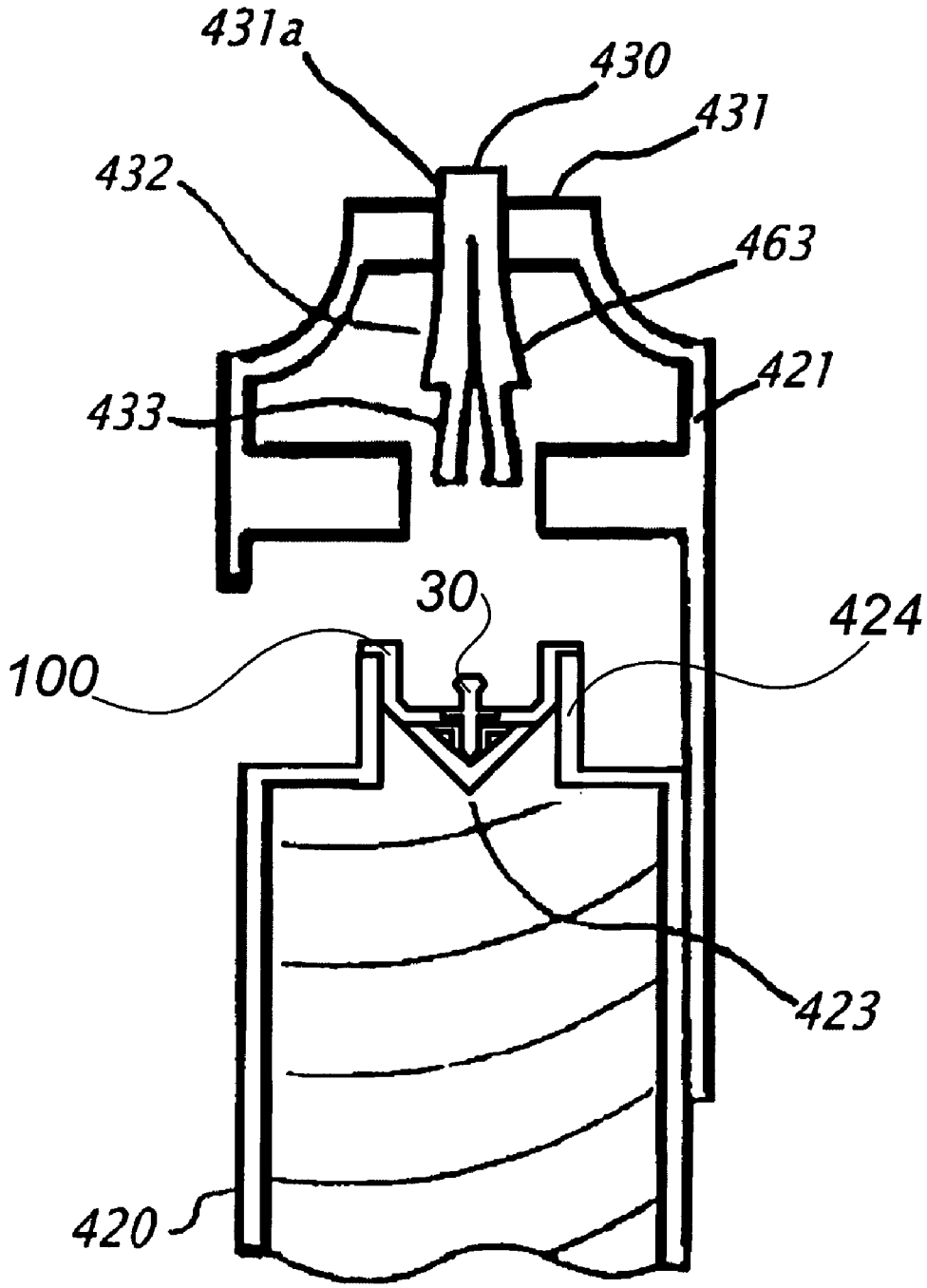
FIG. 1 shows a side sectional view for plugging or unplugging a removable lid for use with a toner or developer container according to one embodiment of the present invention.

The present invention is more particularly described-in the following examples that are intended to be illustrative only since numerous modifications and variations therein will be apparent to those skilled in the art. Various embodiments of the invention are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings. In accordance with the purposes of this invention, as embodied and broadly described herein, this invention, in one aspect, relates to a toner supplying container detachably mountable to an image forming apparatus.

Referring in general to FIGS. 1-4, and in particular to FIG. 1 first, a toner or developer container or bottle 420 in one embodiment shows a mouth portion 423, forming the outlet of the bottle 420. As shown, the bottle 420 is substantially cylindrical and provided with the mouth portion 423 at substantially the center of one end thereof. The mouth portion 423 has a smaller diameter than the cylinder constituting the bottle 420 and has a circular section. In the specific configuration, the mouth portion 423 is formed at the end of a collar 424 extending out from the cylinder 420 and is plugged by a lid 100. The lid 100 can also be used in connection with bottles having other configurations.

In operation, still referring to FIG. 1, a mechanism 432 is utilized for removing the lid 100 from the mouth portion 423 of the bottle 420. As shown, the mechanism 432 is made up of a collect chuck, or retaining means, 430 and moving means, not shown, for moving the chuck 430 toward and away from the bottle 420, depending on the mode of operation. The collect chuck 430 has a chucking portion 433 at the tip thereof, a larger diameter portion 463 adjoining the chucking portion 433, and a smaller diameter portion following the larger diameter portion 463 and is supported by a hole 431*a* formed in a wall 431 that forms a part of a bottle holder 421. When the collect chuck 430 is in a free state, the chucking portion 433 is held open, as shown in FIG. 1. In operation, the bottle 420 is put in a predetermined position on the bottle holder 421. When the collect chuck 430 is moved away from the bottle 420 by the moving means, the peripheral larger diameter portion of the chuck 430 is pressed by the wall of the hole 431*a* with the result that the chucking portion 433 is squeezed to retain a lug member 30 of the lid 100. Subsequently, the chuck 430 moves the lid 100 to a position where the mouth portion 423 of the bottle 420 is fully uncovered, chucking the lug member 30 of the lid 100. In this way, the lid 100 can be utilized to selectively plug or unplug a discharge mouth of a toner or developer container that can be mounted to an image forming apparatus (not shown) for replenishing a toner or developer container.

Figure 2:
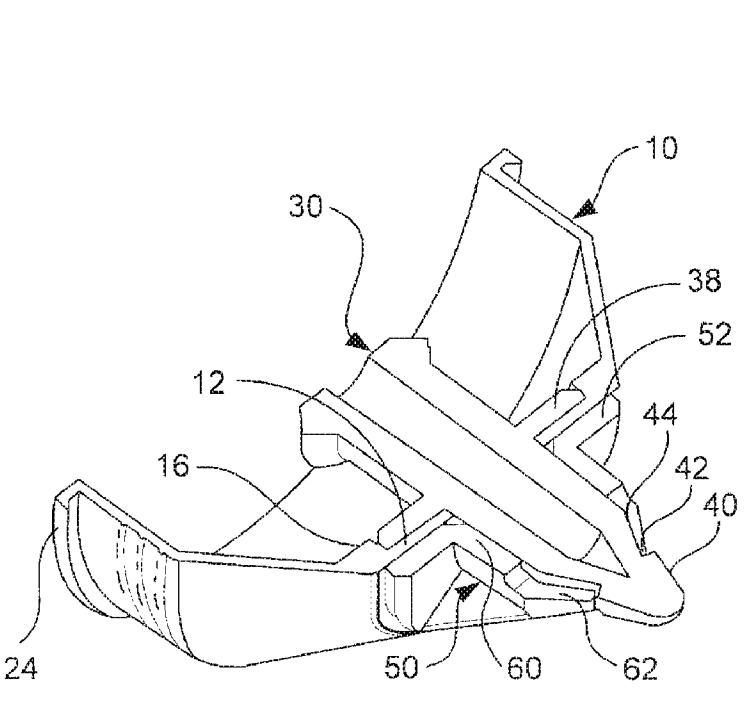
FIG. 2 shows an assembled removable lid for use with a toner or developer container, according to one embodiment of the present invention.
Figure 2:
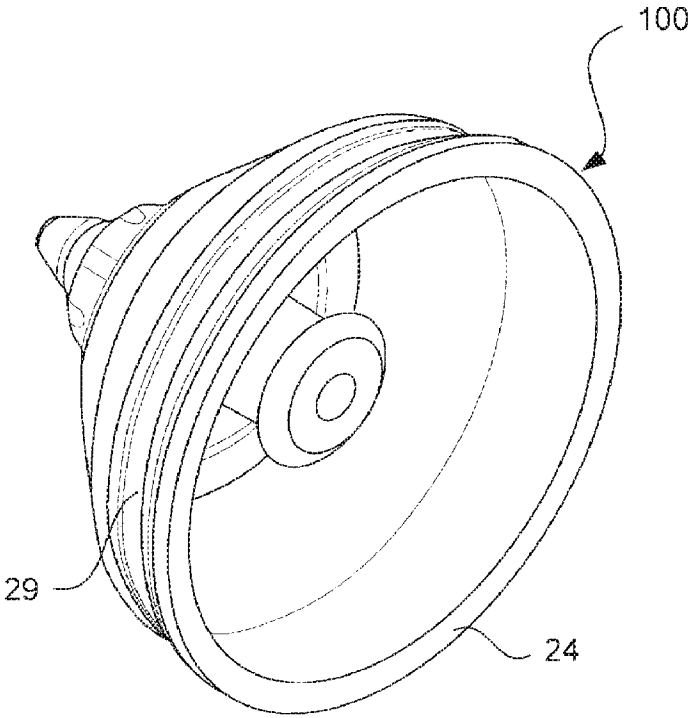
Figure 3:
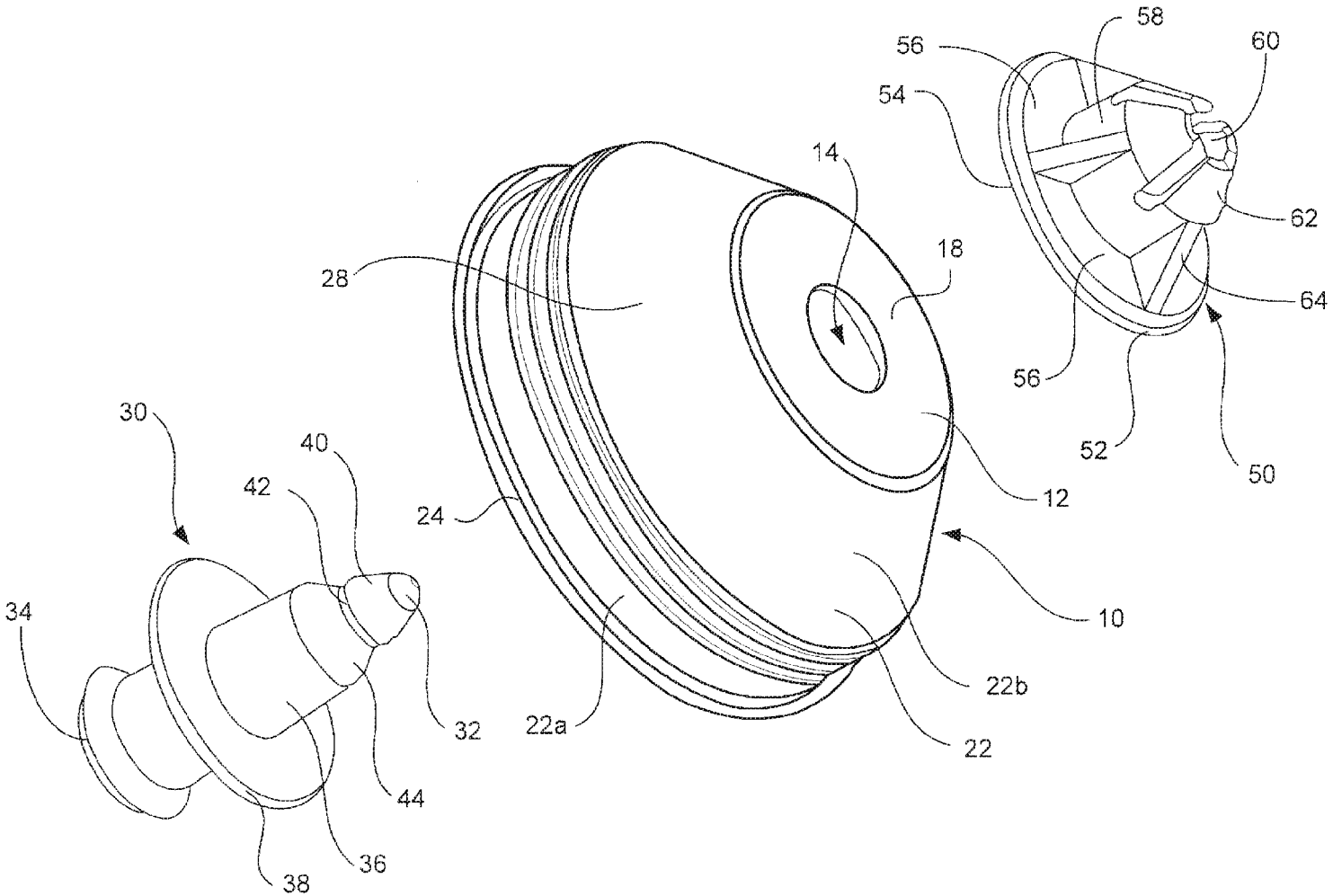
FIG. 3 is an exploded perspective view of a removable lid for use with a toner or developer container according to one embodiment of the present invention.
Figure 4:
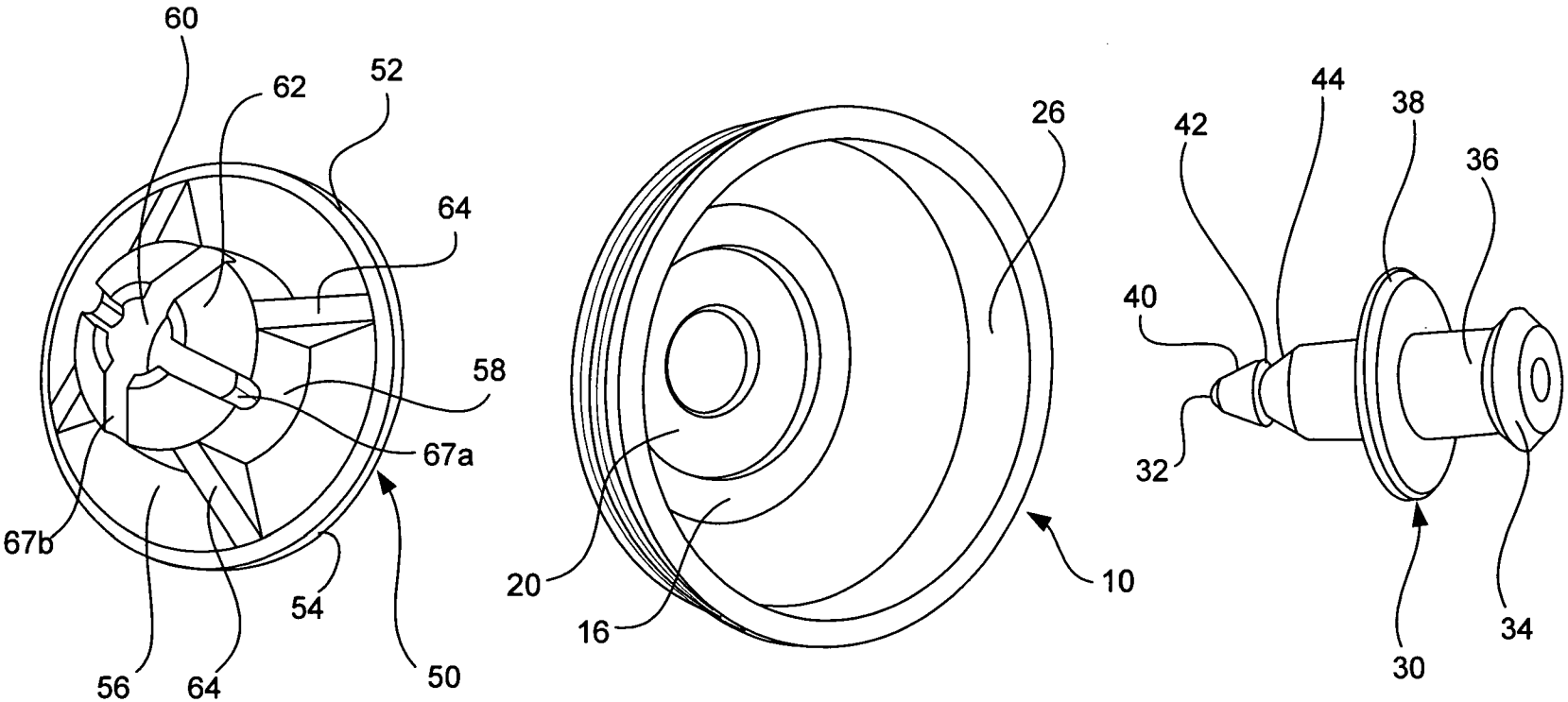
FIG. 4 shows three major components of a removable lid for use with a toner or developer container: (A) a base member, (B) a body member, and (C) a lug member, respectively, according to one embodiment of the present invention.

Referring now to FIGS. 2-4, a removable lid 100 for use with a toner or developer container to selectively plug or unplug a discharge mouth of a toner or developer container mountable to an image forming apparatus for replenishing a toner or developer container according to one embodiment of the present invention is shown. FIG. 2A is a perspective view and FIG. 2B is a perspective sectional view of the lid 100, respectively. In one embodiment, the lid 100 has a body member 10, a lug member 30, and a base member 50.

The body member 10, in one embodiment, has a bottom portion 12 and a sidewall portion 22 defining a bowl-type housing therewith. The bottom portion 12 has an inner surface 16 and an outer surface 18 and defines an opening 14. The sidewall portion 22 has an inner surface 26 and an outer surface 28.

The lug member 30, in one embodiment, has a substantially cylindrical body portion 36 that has a first (tip) end portion 32, and a second end portion 34.

The base member 50, in one embodiment, has a round base portion 52 that has a first surface 54 and an opposite, second surface 56. The base member 50 also has a cylindrical body portion 58 protruding away from the second surface 56. An opening 60 is defined with the base portion 52 of the base member 50.

The body portion 36 of the lug member 30 is sized to be received into the opening 14 of the bottom portion 12 of the body member 10 and into the opening 60 of the base member 50 to engage the body member 10 with the base member 50.

The base portion 52 of the base member 50 is formed such that when the body portion 36 of the lug member 30 is received into the opening 14 of the bottom portion 12 of the body member 10 and into the opening 60 of the base member 50, which is in communication with the opening 14 of the bottom portion 12 of the body member 10, the first end portion 32 of the body portion 36 of the lug member 30 snaggingly fits through the opening 60 of the base member 50. The base member 50 is formed with resilient material such as plastics.

Referring now to FIGS. 2A, 3 and 4, in one embodiment, the body member 10 of the lid 100 further defines a recess 20 on the inner surface 16 of the bottom portion 12 of the body member 10. The recess 20 is sized to receive the engagement portion 38 formed on the body portion 36 of the lug member 30 therein when the body portion 36 of the lug member 30 is received into the opening 14 of the bottom portion 12 of the body member 10 and into the opening 60 of the base member 50.

In one embodiment, the sidewall portion 22 of the body member 10 is formed with two portions: a cylindrical portion 22*a* that has a first edge and an opposite, second edge, and a conical portion 22*b* that has a first edge with a smaller diameter, and an opposite, second edge with a larger diameter. The first edge of the conical portion 22*b* of the body member 10 with a smaller diameter adjoins the bottom portion 12. The second edge of the conical portion 22*b* of the body member 10 with a larger diameter adjoins to the second edge of the cylindrical portion 22*a* of the body member 10. Furthermore, an engaging portion 24 is formed around the opening 14 of the body member 10 and extending outwardly from the sidewall portion 22 of the body member 10 and sized to engage with the discharge mouth of a toner or developer container when the lid 100 plugs the discharge mouth. In another embodiment, the body member 10 may further have a plurality of optional annular ribs 29 formed on the outer surface 28 of the cylindrical portion 22*a*, which may help and facilitate the engagement between the body member 10 and the discharging mouth of a toner or developer container in operation.

Referring now to FIGS. 2B, and 4C, in one embodiment, the lug member 30 further has a ring shaped engagement plate 38 integratedly formed on the body portion 36 of the lug member 30 and extending radially and outwardly from the body portion 36 of the lug member 30. The first end portion 32 of the lug member 30 is formed to have a conical tip portion 40, a conical engagement portion 44, and a step portion 42 joining the conical tip portion 40 and the conical engagement portion 44. The ring shaped engagement plate 38 has a diameter greater than that of any one of the first end portion 32, the second end portion 34 and the body portion 36 of the lug member 30. As such, when the body portion 36 of the lug member 30 is received into the opening 14 of the bottom portion 12 of the body member 10 and into the opening 60 of the base member 50, the first end portion 32 of the lug member 30 snaggingly fits through the opening 60 of the base member 50, and the conical tip portion 62 of the base member 50 is received at the step portion 42 of the first end portion 32 of the lug member 30, the ring shaped engagement plate 38 of the lug member 30 is in contact with the bottom portion 12 of the body member 10, which in turn, is in contact with the base portion 52 of the base member 50, and the second end portion 34 of the lug member 30 is accommodated in the bowl-type housing of the body member 10, as shown in FIGS. 2A and 2B.

Referring now back to FIGS. 3 and 4A, in one embodiment, the base member 50 further has a plurality of grooves equiangularly formed on the conical tip portion 62. In the embodiment shown in FIG. 4A, there are two grooves 67*a* and 67*b* formed substantially perpendicular to each other. Grooves 67*a* and 67*b* are formed to make the base member 50 more resilient and thus easier to receive the first tip portion 32 of the lug member 30 through the opening 60 of the base member 50, namely, when the first tip portion 32 of the lug member 30 penetrates through the opening 60, grooves 67*a*, 67*b* allow the opening 60 to expand radially to allow the first tip portion 32 to be received therein.

In one embodiment, the base member 50 further has a conical tip portion 62 corresponding to the first end portion 32 of the lug member 30 such that when the first end portion 32 of the body portion 36 of the lug member 30 snaggingly fits through the opening 60 of the base member 50, the conical tip portion 62 of the base member 50 is received at the step portion 42 of the first end portion 32 of the lug member 30.

In one embodiment, the base member 50 further has a plurality of ridges formed equiangularly apart from each other on the second surface 56 of the base portion 52 and joining the body portion 58 of the base member 50, which provides further integration between the base portion 52 and the body portion 58 of the base member 50 and allows force to be distributed more equally.

Figure 5:
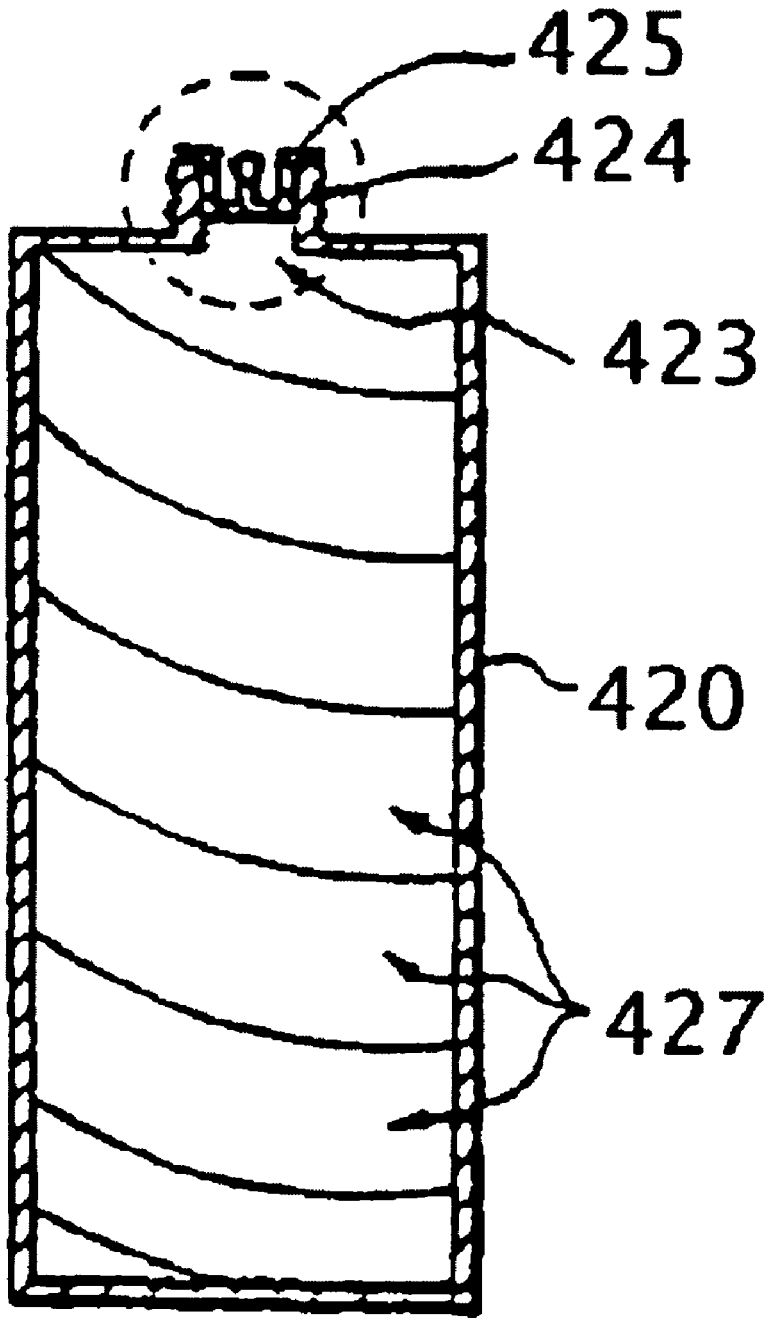
FIG. 5 (RELATED ART)
FIG. 5 is a side view of a toner or developer container with a related art lid for use with an image forming apparatus for replenishing a developer.
Figure 7:
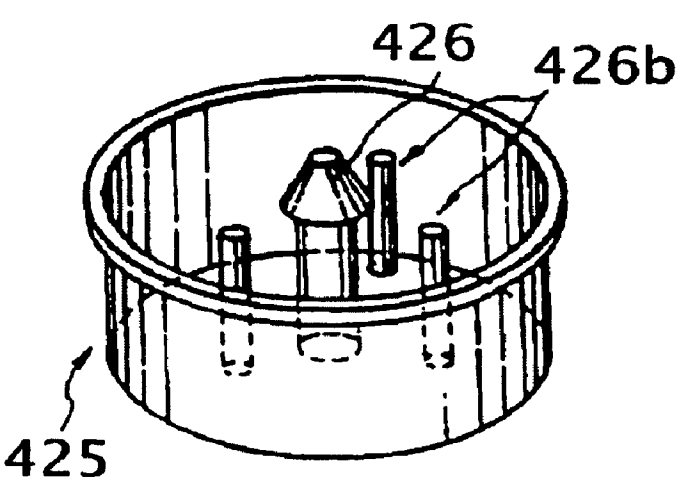
FIG. 7 (RELATED ART)
FIG. 7 is a perspective view of a configuration of a related art lid.
Figure 6:
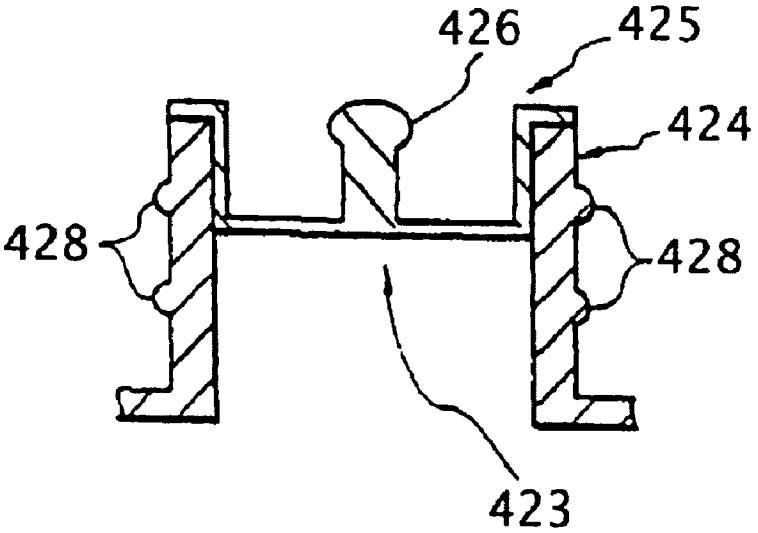
FIG. 6 (RELATED ART)
FIG. 6 is a portion of an enlarged sectional view of the mouth portion of the toner or developer container of FIG. 5.

Thus, as disclosed herein, a lid 100 has at least three advantages over a lid in the art such as the lid 425 shown in FIG. 5:

First, the lug member 30 does not protrude from any surfaces of the body member 10, but forms a snaggingly-fit-engagement with the base member 50. Therefore, even if a user accidentally nips the lug member 30 away from the lid 100 without using a corresponding collect chuck, the body member 10 is not compromised at all. The user can place the lug member 30 back to the lid 100, which can still be used.

Second, a lug member 30 of a lid 100 of the present invention can be replaced easily if it is broken or is accidentally nipped away so that a lid 100 with a replacement lug member 30 can still be used. In contrast, a current lid in the art such as the lid 425 shown in FIG. 5 must be replaced as a whole if a lug member of the current lid such as the lid 425 shown in FIG. 5 is broken or is accidentally nipped away.

Third, the snaggingly-fit-engagement of a lug member 30 and a base member 50 of a lid 100 of the present invention allows any pulling force, whether from a collect chuck or a user, to be distributed over the base portion 52 of the base member 50 and on the same time, and a full integration of the body member 10, the lug member 30 and the base member 50 to be achieved by sandwiching the bottom portion 12 of the body member 10 between the engagement portion 38 of the lug member 30 and the base portion 52 of the base member 50.

To enhance the strength of the lid, ultrasonic welding, heat welding, or molding can be utilized to form a lid 100 that has a configuration as disclosed herein and an integral structure with sufficient mechanical strength to perform properly.

In operation, either of the lid 100 or the lid with features described in various embodiments herein can be utilized in cooperation with a toner bottle such as one is shown in FIG. 5.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modification, both as to equipment details and operating procedures can be effected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

What is claimed is:

1. A lid to selectively plug or unplug a discharge mouth of a toner or developer container mountable to an image forming apparatus for replenishing a toner or developer container, comprising:

(a) a body member having a bottom portion and a sidewall portion extending continuously and conically from the bottom portion to define a bowl-type housing, wherein the bottom portion has an inner surface and an outer surface and defines an opening, and the sidewall portion has an inner surface and an outer surface;

(b) a lug member having a first end portion and a second end portion defining a body portion therebetween, and a ring shaped engagement plate integratedly formed on the body portion between the first end portion and the second end portion and extending radially and outwardly from the body portion, wherein the first end portion comprises a conical tip portion, a conical engagement portion, and a step portion joining the conical tip portion and the conical engagement portion, and wherein the ring shaped engagement plate has a diameter greater than that of any one of the first end portion, the second end portion and the body portion; and (c) a base member having a base portion having a first surface and a second, opposite surface, a body portion protruding away from the second surface and defining an opening with the base portion, a conical tip portion extending from the body portion, and a plurality of grooves formed on the conical tip portion, the conical tip portion corresponding to the first end portion of the lug member, wherein the body portion of the lug member is sized to be received into the opening of the bottom portion of the body member and into the opening of the base member to engage the body member with the base member; and wherein the base portion of the base member is formed with a resilient material such that when the body portion of the lug member is received into the opening of the bottom portion of the body member and into the opening of the base member, which is in communication with the opening of the bottom portion of the body member, the first end portion of the lug member snaggingly fits through the opening of the base member, and the conical tip portion of the base member is received at the step portion of the first end portion of the lug member, the ring shaped engagement plate of the lug member is in contact with the bottom portion of the body member, which in turn, is in contact with the base portion of the base member, and the second end portion of the lug member is accommodated in the bowl-type housing of the body member.

2. The lid of claim 1, wherein the body member further comprises an engaging portion formed around the opening of the body member and extending outwardly from the sidewall portion of the body member and sized to be able to engage with the discharge mouth of a toner or developer container when the lid plugs the discharge mouth.

3. The lid of claim 1, wherein the sidewall portion of the body member comprises a cylindrical portion and a conical portion, wherein the conical portion adjoins the cylindrical portion and the bottom portion.

4. The lid of claim 3, wherein the body member has a plurality of annular ribs formed on the outer surface of the cylindrical portion.

5. The lid of claim 1, wherein the body member further defines a recess on the inner surface of the bottom portion of the body member, and wherein the recess is sized to receive the ring shaped engagement plate integratedly formed on the body portion of the lug member therein when the body portion of the lug member is received into the opening of the bottom portion of the body member and into the opening of the base member.

6. The lid of claim 1, wherein the base member further comprises a plurality of ridges formed equiangularly apart from each other on the second surface of the base portion and joining the body portion of the base member.

7. A lid to selectively plug or unplug a discharge mouth of a toner or developer container mountable to an image forming apparatus for replenishing a toner or developer container, comprising:

(a) a body member having a bottom portion and a sidewall portion extending continuously and conically from the bottom portion to define a bowl-type housing, wherein the bottom portion has an inner surface and an outer surface and defines an opening, and the sidewall portion has an inner surface and an outer surface;

(b) a lug member having a first end portion and a second end portion defining a body portion therebetween, and a ring shaped engagement plate integratedly formed on the body portion between the first end portion and the second end portion and extending radially and outwardly from the body portion, wherein the first end portion comprises a conical tip portion, a conical engagement portion, and a step portion joining the conical tip portion and the conical engagement portion, and wherein the ring shaped engagement plate has a diameter greater than that of any one of the first end portion, the second end portion and the body portion; and (c) a base member having a base portion having a first surface and a second, opposite surface, a body portion protruding away from the second surface and defining an opening with the base portion, a conical tip portion extending from the body portion, and a plurality of grooves formed on the conical tip portion, wherein the body portion of the lug member is sized to be received into the opening of the bottom portion of the body member and into the opening of the base member to engage the body member with the base member, such that the ring shaped engagement plate of the lug member is in contact with the bottom portion of the body member, which in turn, is in contact with the base portion of the base member, and the second end portion of the lug member is accommodated in the bowl-type housing of the body member.

8. The lid of claim 7, wherein the base portion of the base member is formed such that when the body portion of the lug member is received into the opening of the bottom portion of the body member and into the opening of the base member, the first end portion of the body portion of the lug member snaggingly fits through the opening of the base member.

9. The lid of claim 7, wherein the body member further comprises an engaging portion formed around the opening of the body member and extending outwardly from the sidewall portion of the body member and sized to be able to engage with the discharge mouth of a toner or developer container when the lid plugs the discharge mouth.

10. The lid of claim 7, wherein the body member further defines a recess on the inner surface of the bottom portion of the body member, and wherein the recess is sized to receive the ring shaped engagement plate integratedly formed on the body portion of the lug member therein when the body portion of the lug member is received into the opening of the bottom portion of the body member and into the opening of the base member.

11. The lid of claim 7, wherein the base member further comprises a conical tip portion corresponding to the first end portion of the lug member such that when the first end portion of the body portion of the lug member snaggingly fits through the opening of the base member, the conical tip portion of the base member is received at the step portion of the first end portion of the lug member.

* * * * *